US008573175B2

(12) United States Patent
Wakamatsu et al.

(10) Patent No.: US 8,573,175 B2
(45) Date of Patent: Nov. 5, 2013

(54) AIR INTAKE DEVICE FOR INTERNAL COMBUSTION ENGINE

(75) Inventors: Takeshi Wakamatsu, Wako (JP); Jin Yamagishi, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 13/557,218

(22) Filed: Jul. 25, 2012

(65) Prior Publication Data

US 2013/0098326 A1 Apr. 25, 2013

(30) Foreign Application Priority Data

Oct. 20, 2011 (JP) ..... 2011-230836

(51) Int. Cl.
*F02M 35/10* (2006.01)

(52) U.S. Cl.
USPC ..... 123/184.56; 123/184.55

(58) Field of Classification Search
USPC ..... 123/184.56, 184.55, 184.21
See application file for complete search history.

(56) References Cited

U.S. PATENT DOCUMENTS 2,901,229 A * 8/1959 Sarto ..... 261/39.3
4,333,441 A * 6/1982 Still et al. ..... 48/189.4
5,823,150 A * 10/1998 Konakawa ..... 123/73 V
5,970,963 A * 10/1999 Nakase et al. ..... 123/590
6,591,804 B2 * 7/2003 Matsumoto et al. ..... 123/184.55
6,843,224 B2 * 1/2005 Ha ..... 123/337
7,131,514 B2 * 11/2006 Choi et al. ..... 181/270
7,299,787 B2 * 11/2007 Sasaki et al. ..... 123/337
7,730,997 B2 * 6/2010 Asada et al. ..... 181/270
2006/0219202 A1 * 10/2006 Abe et al. ..... 123/184.56

FOREIGN PATENT DOCUMENTS

JP 3430840 B2 9/1998

* cited by examiner

*Primary Examiner* — Noah Kamen
*Assistant Examiner* — Long T Tran
(74) *Attorney, Agent, or Firm* — Ditthavong Mori & Steiner, P.C.

(57) ABSTRACT

An air intake device for an internal combustion engine includes an air intake path, a throttle valve, and a first partition plate. The throttle valve is provided in the air intake path and includes a valve shaft and a valve body. The valve body is connected to the valve shaft to open and close the air intake path and has a first end and a second end. The first partition plate is disposed approximately parallel to a flow direction of intake air and includes opposite ends connected to a first inner wall surface of the air intake path closer to the first end than the second end. The first partition plate has a substantially curved convex shape protruding radially inward of the air intake path. The first partition plate is located downstream of the first end of the valve body.

11 Claims, 4 Drawing Sheets

AIR INTAKE DEVICE FOR INTERNAL COMBUSTION ENGINE

CROSS-REFERENCE TO RELATED APPLICATIONS

The present application claims priority under 35 U.S.C. §119 to Japanese Patent Application No. 2011-230836, filed Oct. 20, 2011, entitled "Air Intake Device for Internal Combustion Engine." The contents of this application are incorporated herein by reference in their entirety.

BACKGROUND OF THE INVENTION

1. Field of the Invention

The present disclosure relates to an air intake device for an internal combustion engine.

2. Discussion of the Background

An intake noise reducing device for a throttle valve is known from Japanese Patent No. 3430840. The device includes a cylinder or a partial cylinder disposed approximately parallel to the flow direction of intake air, in a radially central part of an air intake path on the downstream side of a valve body of a throttle valve. When the throttle valve is opened, an opening is formed between the air intake path and the valve body. A high-velocity air flow that has passed through this opening is caused to pass through a gap between the inner peripheral surface of the air intake path and the outer peripheral surface of the cylinder or the partial cylinder and is regulated. This prevents vortexes from being generated at the boundary between the high-velocity air flow and another low-velocity air flow.

SUMMARY OF THE INVENTION

According to one aspect of the present invention, an air intake device for an internal combustion engine includes an air intake path, a throttle valve, and a first partition plate. Intake air flows through the air intake path. The throttle valve is provided in the air intake path and includes a valve shaft and a valve body. The valve shaft is rotatable relative to the air intake path. The valve body has a plate shape and is connected to the valve shaft to open and close the air intake path. The valve body includes a first end and a second end. The first end moves to an upstream side of the air intake path when the valve body rotates to open the air intake path. The second end moves to a downstream side of the air intake path when the valve body rotates to open the air intake path. The first partition plate is disposed approximately parallel to a flow direction of the intake air and includes opposite ends connected to a first inner wall surface of the air intake path closer to the first end than the second end. The first partition plate has a substantially curved convex protruding radially inward of the air intake path. The first partition plate is located downstream of the first end of the valve body.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

DESCRIPTION OF THE EMBODIMENTS

Figure 1:
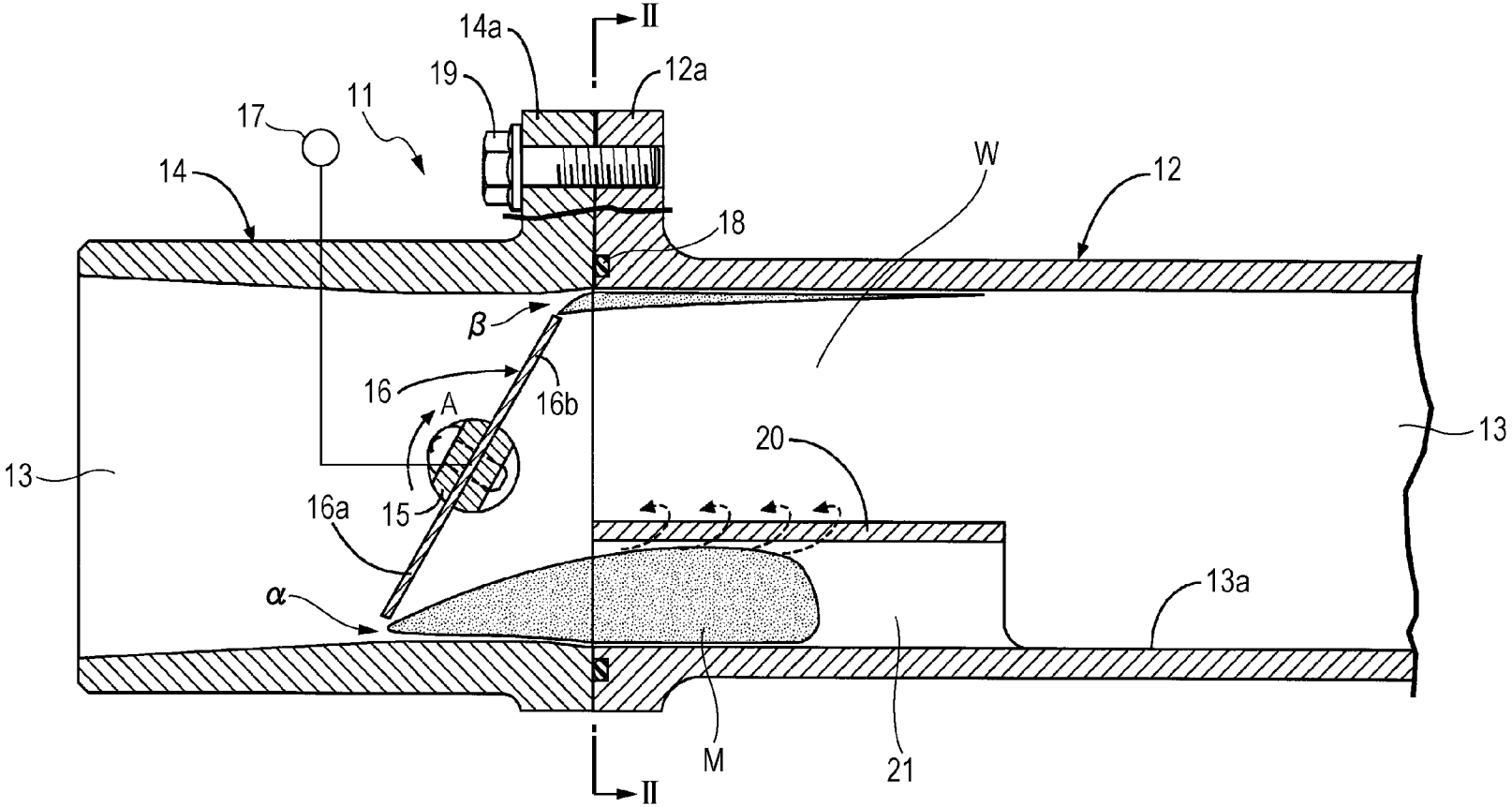
FIG. 1 is a vertical sectional view of an air intake device for an internal combustion engine (first embodiment).

The embodiments will now be described with reference to the accompanying drawings, wherein like reference numerals designate corresponding or identical elements throughout the various drawings.

A first embodiment of the present disclosure will be described with reference to FIG. 1 and FIG. 2.

An air intake device that supplies intake air to a combustion chamber of an internal combustion engine has a throttle valve 11 on the upstream side and an air intake pipe 12 on the downstream side. An air cleaner (not shown) is connected to the upstream side of the throttle valve 11, and a cylinder head (not shown) is connected to the downstream side of the air intake pipe 12. An air intake path 13 through which intake air flows is formed in the throttle valve 11 and the air intake pipe 12.

The throttle valve 11 has a throttle body 14 through which the air intake path 13 that is circular in cross-section penetrates, a valve shaft 15 provided so as to intersect with the air intake path 13, and a disk-shaped valve body 16 fixed to the valve shaft 15. The valve shaft 15 is rotationally driven by an electric actuator 17 within a predetermined angle range. The throttle body 14 and the air intake pipe 12 have flanges 14*a* and 12*a*, respectively, formed at their ends facing each other. The throttle body 14 and the air intake pipe 12 are joined together by fastening the flanges 14*a* and 12*a* together, with an O-ring 18 therebetween, with bolts 19.

When the valve body 16 is in a closed state, the outer peripheral part of the valve body 16 adheres firmly to the inner peripheral surface of the air intake path 13, and the flow of intake air is completely blocked. By driving the valve shaft 15 with the electric actuator 17, the valve body 16 is rotated in the direction of arrow A. A first end 16*a* of the valve body 16 moves to the upstream side in the flow direction of intake air, and a second end 16*b* of the valve body 16 moves to the downstream side in the flow direction of intake air.

Although the gap $\alpha$ formed between the first end 16*a* of the valve body 16 and the inner peripheral surface of the air intake path 13 is the same size as the gap $\beta$ formed between the second end 16*b* of the valve body 16 and the inner peripheral surface of the air intake path 13, the quantity of flow of intake air passing through the gap $\alpha$ at the first end 16*a* of the valve body 16 is larger than the quantity of flow of intake air passing through the gap $\beta$ at the second end 16*b* of the valve body 16. As a result, the flow velocity of the flow of intake air generated on the downstream side of the gap $\alpha$ (hereinafter referred to as primary flow M) is higher than the flow velocity of the flow of intake air generated on the downstream side of the gap $\beta$, and this primary flow M is a major cause of intake noise.

Both ends of a semi-cylindrical first partition plate 20 protruding radially toward the inside of the air intake path 13 are fixed to part of the wall surface 13*a* of the air intake path 13 of the air intake pipe 12 facing the first end 16*a* of the valve body 16, that is, to the wall surface 13*a* of the lower half, in the figure, of the air intake path 13 of the air intake pipe 12. The first partition plate 20 is disposed parallel to the air intake path 13. That is, the direction of the generatrix of the first partition plate 20 is parallel to the axis of the air intake path 13. By this first partition plate 20, a first flow path 21 extending in the flow direction of intake air is formed between the first partition plate 20 and the wall surface 13*a* of the air intake path 13.

Next, the operation of the embodiment of the present disclosure with the above-described configuration will be described.

From a state where the throttle valve 11 is closed and the valve body 16 is completely blocking the air intake path 13, the electric actuator 17 operates and the valve shaft 15 rotates. The first end 16*a* of the valve body 16 moves to the upstream side, and the second end 16*b* of the valve body 16 moves to the downstream side. Intake air that has passed through the gap α formed between the first end 16*a* of the valve body 16 and the inner peripheral surface of the air intake path 13 and the gap β formed between the second end 16*b* of the valve body 16 and the inner peripheral surface of the air intake path 13 flows into the air intake pipe 12. At this time, most of the high-velocity primary flow M that has passed through the gap α, which causes intake noise, is confined in the tubular first flow path 21 formed between the lower wall surface 13*a* of the air intake path 13 and the first partition plate 20 and is prevented from being mixed with low-velocity intake air in a stagnation region above the first flow path 21 (hereinafter referred to as secondary flow W). Thus, the generation of vortexes (see the dashed arrows in FIG. 1) in the boundary part between flows of different flow velocities can be minimized, and the intake noise can be suppressed.

Figure 2:
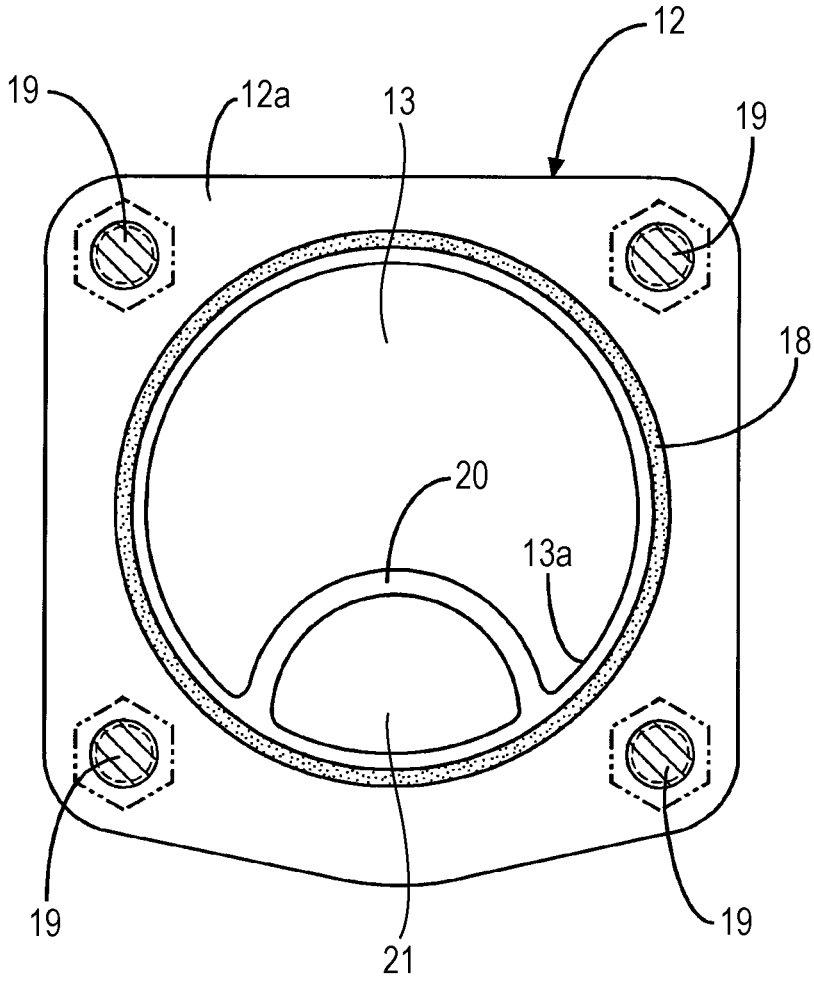
FIG. 2 is a sectional view taken along line II-II of FIG. 1 (first embodiment).

As described above, according to this embodiment, a first flow path 21 is formed between the lower wall surface 13*a* of the air intake path 13 and the first partition plate 20, and the cross-section of the first flow path 21 perpendicular to the flow direction of intake air is closed (see FIG. 2). Thus, the primary flow M can be reliably separated from the secondary flow W, and the intake noise suppressing effect can be improved.

Figure 3:
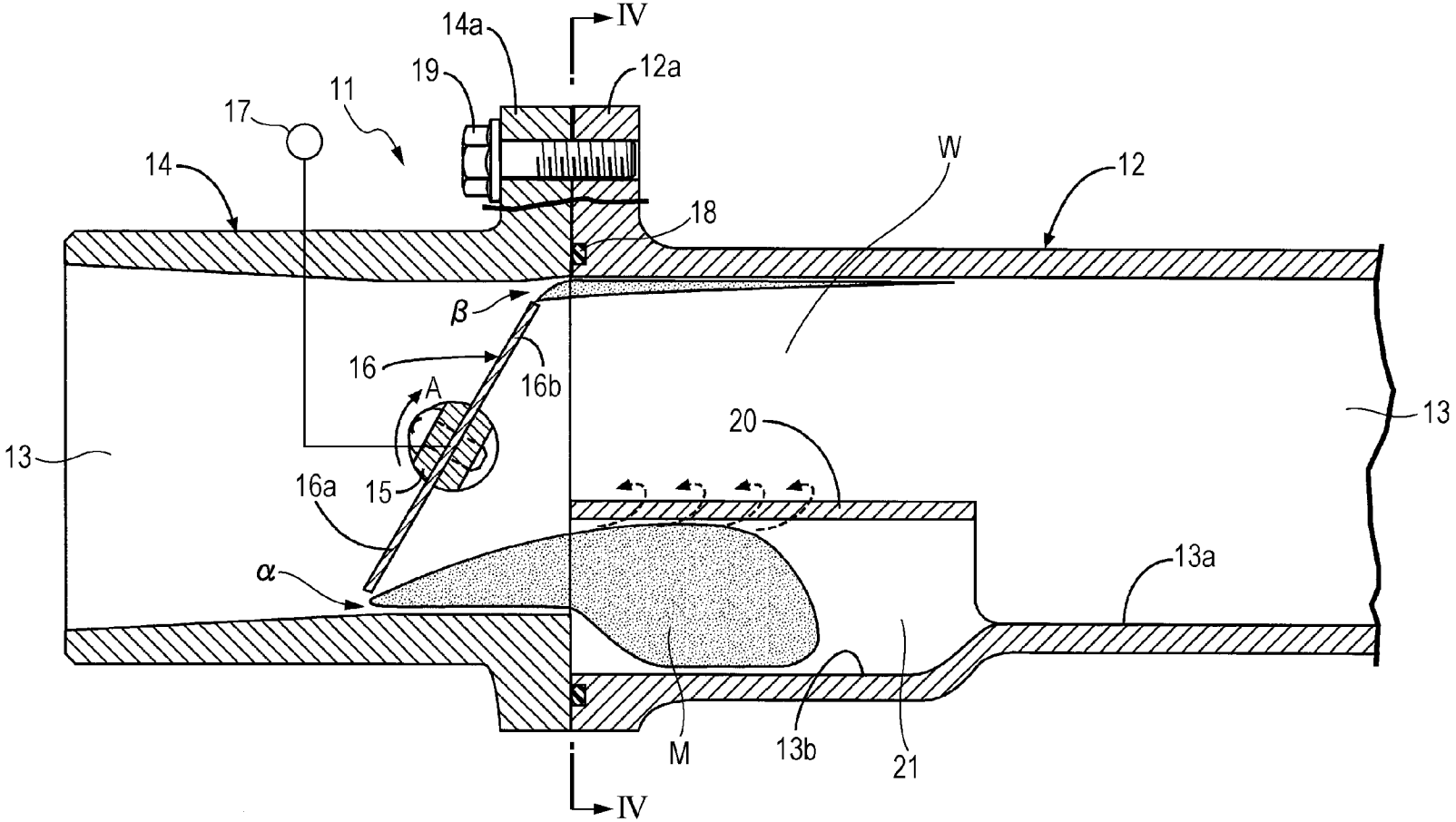
FIG. 3 is a vertical sectional view of an air intake device for an internal combustion engine (second embodiment).
Figure 4:
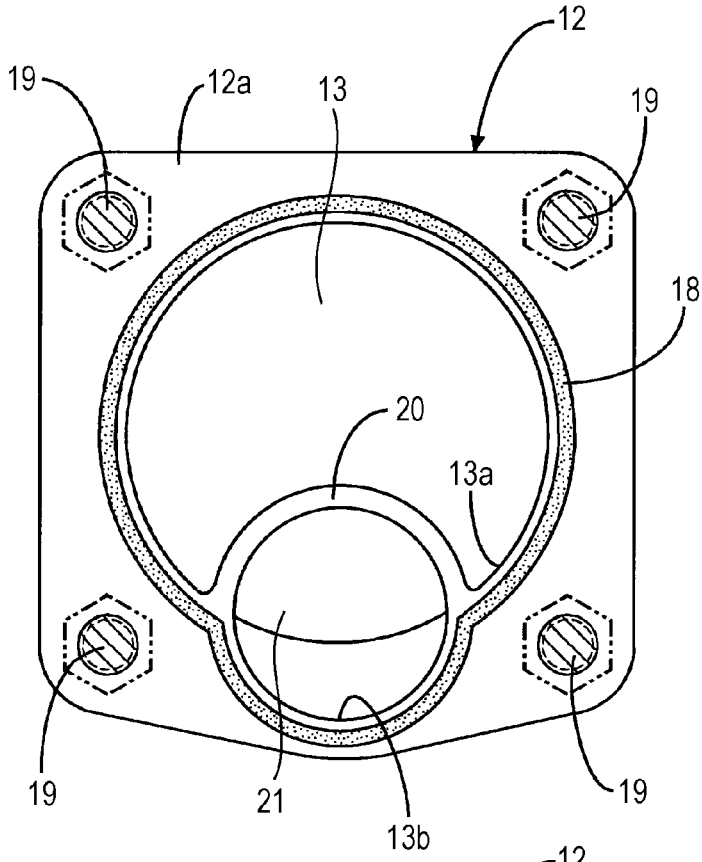
FIG. 4 is a sectional view taken along line IV-IV of FIG. 3 (second embodiment).

Next, a second embodiment of the present disclosure will be described with reference to FIG. 3 and FIG. 4.

In the first embodiment, the wall surface 13*a* of the air intake path 13 of the air intake pipe 12 provided with the first partition plate 20 is circular in cross-section. In the second embodiment, a groove-like recess 13*b* depressed radially outwardly is formed in part of the wall surface 13*a* of the air intake path 13 facing the lower side of the first partition plate 20. The first partition plate 20 and the recess 13*b* form, in cooperation with each other, a first flow path 21 that is circular in cross-section. The formation of the recess 13*b* increases the cross-sectional area of the first flow path 21 through which the primary flow M flows.

This increase in cross-sectional area of flow path reduces the flow velocity of the primary flow M. Thus, vortexes generated in a part at the downstream end of the first partition plate 20 where the primary flow M and the secondary flow W join together can be suppressed, and the intake noise can be suppressed more effectively.

Figure 5:
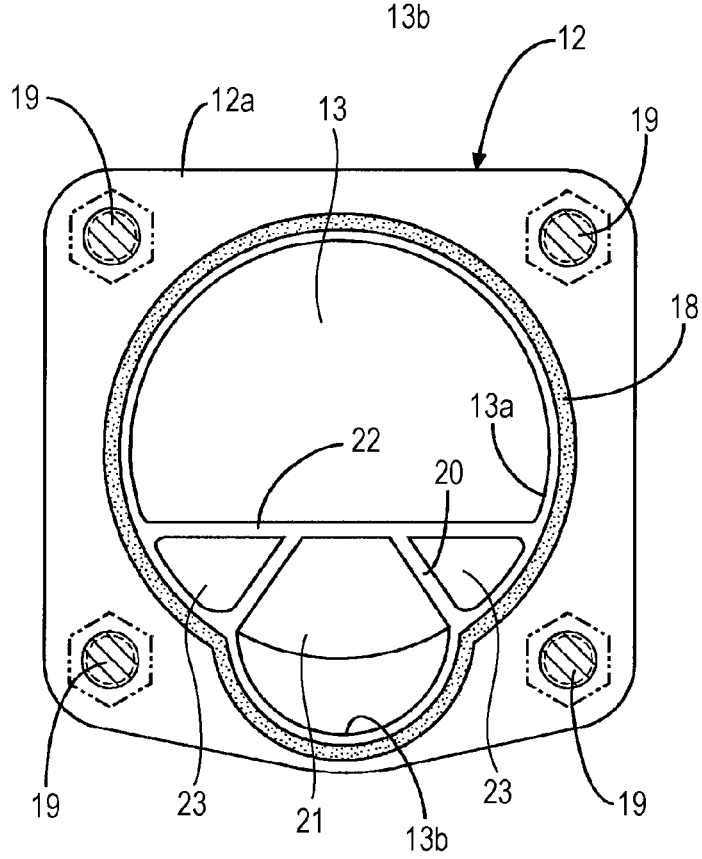
FIG. 5 is a view corresponding to FIG. 2 and FIG. 4 (third embodiment).

Next, a third embodiment of the present disclosure will be described with reference to FIG. 5.

The third embodiment is a modification of the second embodiment in which the air intake path 13 is provided with a recess 13*b*. In the second embodiment, the first partition plate 20 is circular in cross-section. In the third embodiment, the first partition plate 20 is trapezoidal in cross-section. In addition, a flat plate-like second partition plate 22 is disposed above the first partition plate 20. The middle part of the second partition plate 22 is connected to the middle part of the first partition plate 20. Both ends of the second partition plate 22 are connected to the wall surface 13*a* of the air intake path 13.

As a result, the rigidity of the first partition plate 20 is improved by the second partition plate 22. Thus, the first partition plate 20 can be prevented from being vibrated by the air flow, and secondary intake noise generated by the vibration of the first partition plate 20 can be suppressed. Two second flow paths 23, 23 that are triangular in cross-section are formed between the first partition plate 20, the second partition plate 22, and the wall surface 13*a* of the air intake path 13. Thus, part of the primary flow M that does not pass through the first flow path 21 formed between the first partition plate 20 and the wall surface 13*a* of the air intake path 13 can be surrounded with the two second flow paths 23, 23. The primary flow M can be separated from the secondary flow W more reliably. The intake noise suppressing effect can be improved.

Although embodiments of the present disclosure have been described, various design changes may be made without departing from the scope of the present disclosure.

For example, the first partition plate 20 is not limited to that of the first embodiment, which is circular in cross-section or that of the third embodiment, which is trapezoidal in cross-section, and may have any other cross-sectional shape such as a triangular shape as long as it curves in a convex manner radially toward the inside of the air intake path 13.

The cross-sectional shape of the recess 13*b* in the wall surface 13*a* of the air intake path 13 is not limited to a circular shape in the second and third embodiments as long as it is depressed from the wall surface 13*a* of the air intake path 13 radially outwardly.

In an aspect of the present disclosure, an air intake device for an internal combustion engine includes a throttle valve for an internal combustion engine having a plate-like valve body that is fixed to a rotatable valve shaft and opens and closes an air intake path. The rotation of the valve shaft moves a first end of the valve body to the upstream side of the air intake path and moves a second end of the valve body to the downstream side of the air intake path. Both ends of a first partition plate that is disposed approximately parallel to the flow direction of intake air and curves in a convex manner radially toward the inside of the air intake path are fixed to a wall surface of the air intake path located downstream of the valve body and facing the first end of the valve body.

The rotation of a valve shaft of a throttle valve disposed in an air intake path of an internal combustion engine moves a first end of a plate-like valve body to the upstream side of the air intake path and moves a second end of the valve body to the downstream side of the air intake path. A high-velocity primary flow that has passed through a gap formed between the first end of the valve body and the wall surface of the air intake path is mixed with a secondary flow in a stagnation region downstream of the valve body, and vortexes are generated. This causes intake noise. However, the primary flow is surrounded by the wall surface of the air intake path and the first partition plate and is prevented from being mixed with the secondary flow. The generation of vortexes is suppressed, and intake noise can be effectively reduced.

It is preferable that the air intake device for an internal combustion engine further include a flat plate-like second partition plate disposed approximately parallel to the flow direction of intake air, both ends of the second partition plate be fixed to the wall surface of the air intake path, and the middle part of the second partition plate be fixed to the middle part of the first partition plate.

In this case, the rigidity of the first partition plate is improved by the second partition plate, and the generation of secondary intake noise due to the vibration of the first partition plate can be prevented. In addition, part of the primary flow that flows on the outer side of the first partition plate is surrounded by the second partition plate, and the intake noise can be reduced more effectively.

It is preferable that a recess depressed radially toward the outside of the air intake path be formed in the wall surface of the air intake path facing the first partition plate.

In this case, the recess increases the cross-sectional area of the flow path downstream of the gap formed at the first end of the valve body and decreases the flow velocity of the primary flow. The difference in velocity when the primary flow and the secondary flow join together on the downstream side of the first partition plate is reduced, and the intake noise can be reduced more effectively.

Obviously, numerous modifications and variations of the present invention are possible in light of the above teachings. It is therefore to be understood that within the scope of the appended claims, the invention may be practiced otherwise than as specifically described herein.

What is claimed is:

1. An air intake device for an internal combustion engine, comprising:

an air intake path through which intake air flows;

a throttle valve provided in the air intake path and comprising:

a valve shaft rotatable relative to the air intake path; and a valve body having a plate shape and connected to the valve shaft to open and close the air intake path, the valve body including a first end and a second end, the first end moving to an upstream side of the air intake path when the valve body rotates to open the air intake path, the second end moving to a downstream side of the air intake path when the valve body rotates to open the air intake path; and a first partition plate disposed approximately parallel to a flow direction of the intake air and including opposite ends connected to a first inner wall surface of the air intake path closer to the first end than the second end, the first partition plate having a substantially curved convex shape protruding radially inward of the air intake path, the first partition plate having the opposite ends connected to the first inner wall surface at locations downstream of the first end of the valve body, wherein a first air flow path is defined between the first partition plate and the first inner wall surface of the air intake path.

2. The air intake device for an internal combustion engine according to claim 1, further comprising:

a second partition plate having a flat plate shape and disposed approximately parallel to the flow direction of the intake air, wherein the second partition plate includes opposite ends connected to the first inner wall surface of the air intake path, and a middle part connected to a middle part of the first partition plate.

3. The air intake device for an internal combustion engine according to claim 1, wherein the air intake path includes a recess depressed radially outward of the air intake path, the recess being provided in the first inner wall surface of the air intake path and facing the first partition plate.

4. The air intake device for an internal combustion engine according to claim 1, wherein the first partition plate includes a middle part spaced apart from the first inner wall surface of the air intake path.

5. The air intake device for an internal combustion engine according to claim 1, wherein the air intake path includes a second inner wall surface opposite to the first inner wall surface with respect to the first partition plate, and wherein a second air flow path is defined between the first partition plate and the second inner wall surface of the air intake path.

6. The air intake device for an internal combustion engine according to claim 5, wherein a cross-sectional area of the first air flow path is smaller than a cross-sectional area of the second air flow path.

7. The air intake device for an internal combustion engine according to claim 1, wherein the first partition plate has a curved convex shape protruding radially inward of the air intake path.

8. The air intake device for an internal combustion engine according to claim 1, wherein the first partition plate is semi-cylindrical in shape and the opposite ends of the first partition plate connected to the first inner wall surface protrude radially toward an inside of the air intake path.

9. The air intake device for an internal combustion engine according to claim 1, wherein the first end of the valve body is aligned with the first air flow path when viewed along an axial direction of the air intake path.

10. The air intake device for an internal combustion engine according to claim 1, wherein the air intake path includes a recess depressed radially outward of the air intake path, the recess being provided in the first inner wall surface of the air intake path, and the recess being directly opposite to the first partition plate.

11. The air intake device for an internal combustion engine according to claim 1, wherein the air intake path includes a recess depressed radially outward of the air intake path, the recess being provided in the first inner wall surface of the air intake path, and the recess being provided within the first air flow path.

* * * * *